United States Patent [19]

Noll

[11] 4,381,927

[45] May 3, 1983

[54] CORONA ELECTRODE APPARATUS

[75] Inventor: Charles G. Noll, Gahanna, Ohio

[73] Assignee: United McGill Corporation, Columbus, Ohio

[21] Appl. No.: 256,931

[22] Filed: Apr. 23, 1981

[51] Int. Cl.[3] ..... B03C 3/00

[52] U.S. Cl. ..... 55/138; 55/148; 55/151; 55/152; 55/154

[58] Field of Search ..... 55/150–153, 55/136–138, 148, 129, 154; 361/225–235

[56] References Cited

U.S. PATENT DOCUMENTS

| | | | |
|---|---|---|---|
| 2,698,669 | 1/1955 | Wintermute | 55/152 |
| 3,803,808 | 4/1974 | Shibaya et al. | 55/154 |
| 4,056,372 | 11/1977 | Hayashi | 55/152 |
| 4,119,416 | 10/1978 | Hayashi et al. | 55/151 |
| 4,126,434 | 11/1978 | Keiichi et al. | 55/152 |

FOREIGN PATENT DOCUMENTS

| | | | |
|---|---|---|---|
| 52-7075 | 1/1977 | Japan | 55/152 |
| 54-19273 | 2/1979 | Japan | 55/152 |

*Primary Examiner*—Bernard Nozick

*Attorney, Agent, or Firm*—LeBlanc, Nolan, Shur & Nies

[57] ABSTRACT

An improved corona electrode for use in an electrostatic precipitator of the parallel plate type that includes the addition of a second corona producing electrode adjacent to and in common plane with a needle-type corona producing electrode secured to a vertical edge of the collecting plates. By locating the two corona electrodes a specific distance apart forms a highly efficent corona electrode pair in proper proximity to a collection plate, gas-borne particles, even very high resistivity particles are more effectively charged, and their collection is promoted through both electrostatic and hydrodynamic collection mechanisms.

11 Claims, 10 Drawing Figures

CORONA ELECTRODE APPARATUS

BACKGROUND OF THE INVENTION

1. Field of the Invention

This invention relates to an improved electrode arrangement for use in an electrostatic precipitator that aids the efficient collection and elimination of dusts and mists from industrial effluent gases before they are released to the atmosphere.

2. Description of the Prior Art

The efficient collection and removal of the many and various dusts and mists that are found in industrial gases has always been the goal of and is the basis for continued improvements in the electrostatic precipitator field.

Since the pioneering work of Cottrell, the conventional electrostatic precipitator has utilized an electrical corona between two electrodes for the charging and collection of dusts and mists. However, the use of such a method results in inefficiency in particle charging. This inefficiency is particularly apparent when the electrical corona is used for charging dusts and mists which have a very high resistivity (greater than $1\times10^{11}$ *ohn-cm*).

A more recent development exemplified by the invention in U.S. Pat. No. 4,056,372 to T. Hayashi separated the charging region from a corona-free collection region. This development greatly enhanced the energy efficiency of the electrostatic precipitator. However, some very high resistivity dusts remained difficult to collect.

Some improvement in collecting the harder to collect dusts has also been achieved by adding stages of collection in series with respect to the direction of gas flow, each stage consisting of an electrostatic precipitator for example of the Hayashi type. Large industrial assemblies with as many as 4 or 5 stages are routinely offered by the industry with only partial success in treating the very high resistivity dusts. Such large multi-staged electrostatic precipitators are very costly and take up large amounts of space around industrial plants. This problem is particularly acute at many older plants which have little or no space remaining in which to locate the now required air pollution control equipment for which they were never originally designed.

Electrostatic precipitators of the type to which the present improvement pertains are referred to as being of the parallel plate type. Such an electrostatic precipitator has a collection region that comprises a pack of parallel equally spaced plates suspended so they are parallel to the direction of gas flow through the electrostatic precipitator chamber or plenum. Each plate thus has a leading and trailing edge which are respectively the upstream and downstream edges of the plate as defined by the direction of gas flow. This pack of plates is further divided into two sets of plates such that every other plate belongs to the same set. Each set is maintained at a different electrical potential by a D.C. power source so that every plate (except those forming the outer boundaries of the plate pack nearest the walls of the plenum) is adjacent to two plates of a potential different from itself; those latter two plates thus described being at the same potential. This produces an electrostatic field between every pair of adjacent plates.

Particle collection is the product of two phenomena, both of which involve moving the particle to a collection surface. One phenomenon is the electrical wind of ions that transfers its momentum in the direction of a charged collection surface to the particles regardless of the charge on the particle itself. In the field of this invention this is called the hydrodynamic effect. In the second phenomenon, the particle itself is charged in the electrical corona which charge then allows the particle to be attracted to a collection plate of opposite polarity with respect to the charge on the particle. Without this charge, the particle is not acted upon by the electrical field in the collection region of the electrostatic precipitator.

Recent work has focused its attention on improved particle charging. This work has involved establishment of wholly separate charging and collection regions as exemplified by U.S. Pat. No. 3,803,808 to Shibuya et al. and the subsequent enlargement of the charging region. Again, this approach was only partially successful, and space utilization remained a distinct problem.

SUMMARY OF THE INVENTION

Accordingly, the primary object of the present invention resides in the provision of an improved novel corona electrode section connected to the electrode plates.

Further objects reside in the provision of a strip of corona producing needles that is secured to and cooperates with a first set of corona producing needles that are in turn secured to the leading and/or trailing edges of collecting plates.

Still further objects of the invention reside in the provision of a weighted wire type corona producing electrode that is suspended adjacent to a set of corona producing needles that are secured to the leading edge of collecting plates.

The foregoing objectives involve the improvement of the corona electrode of the Hayashi structure. The novel placement of a second corona producing element near the needle strip corona producing electrode such that the two corona regions cooperate with each other and the electric field of the collecting plates to produce an unusually and uniquely efficient corona electrode. The two corona electrodes being adjacent to each other and parallel to the direction of gas flow, constitute a corona electrode pair. The distance between the two corona electrodes in a pair and the distance from the pair to the plate edge is controlled so that the maximum intensity of ion bombardment is sustained on a dust particle traversing the region.

The problems discussed previously have been substantially eliminated by the unique structural and interrelated functional aspects of the charging section in an electrostatic precipitator of the present invention. This novel structure has resulted in improvement in performance of an electrostatic precipitator in the collection of all dusts and in reducing the length of an electrostatic precipitator needed for a given application; improvement in performance of an electrostatic precipitator in the collection of very high resistivity dusts; and in providing an inexpensive way to retroactively upgrade existing electrostatic precipitator installations. The present invention achieves the foregoing objectives by viewing the precipitator as a whole. An active corona region that provides for longer particle residence time in the charging area has been placed in optimum proximity to a passive, static field collection region. This produces the effect of adequately charging even very high resistivity dusts by subjecting them to an intense corona region for a longer period of time, followed immediately by the collection zone that cooperates to provide a collection surface and a propelling static field for the now adequately charged particles.

Further novel features and other objects of this invention will become apparent from the following detailed description, discussion and the claims taken in conjunction with the accompanying drawings.

DESCRIPTION OF THE PREFERRED EMBODIMENT

Figure 1:
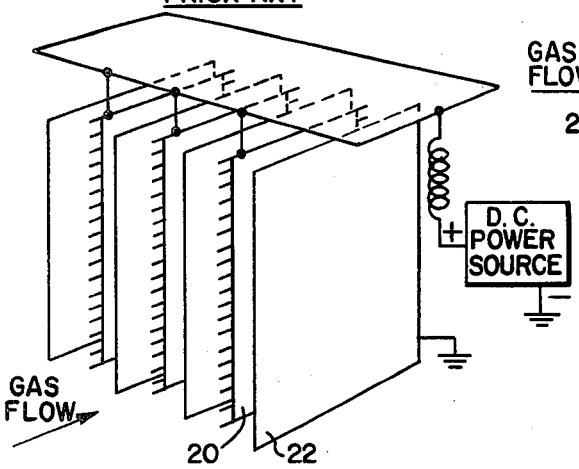
Fig. 1 PRIOR ART
FIG. 1 is a perspective view of a prior art complete elecrostatic precipitator in combination with which the present invention can be practiced.
Figure 2:
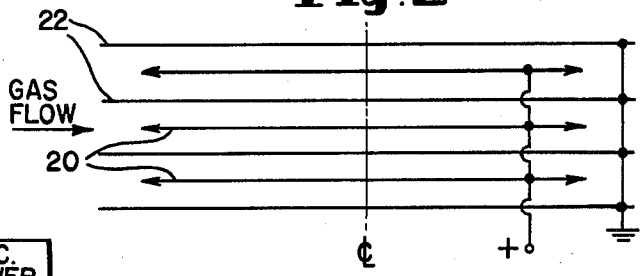
FIG. 2 is a plan view of plate and electrode placement in a FIG. 1 precipitator.

Drawing FIG. 1 shows a perspective view of the primary elements comprising a prior art electrostatic precipitator in combination with which the present invention can be utilized. The plates 20 and 22 in the plate pack are manufactured of steel of approximately 0.090 inch thickness although plate thickness is not a critical parameter except for structural integrity and maintenance of a flat, planar surface. The plate pack (FIG. 2) includes two sets of a plurality of plates, 20 and 22. The plates in each set are parallel to each other, equally spaced to each other and aligned with the direction of gas flow. Both sets have the same equal spacing. The two sets have been aligned with each other so that the plates 20 are bisecting the space between the plates 22, as depicted in FIG. 2. In this embodiment, the plates 20 are not as long in the direction of airflow as are the plates 22. The two sets of plates are suspended in parallel relationship so that the difference in length between plates 20 and plates 22 is equally divided between the entry and exit of the precipitator plate pack leaving a charging zone adjacent to the ends of each plate 20 and between the ends of plates 22. As will become apparent, this charging zone is most critical to this invention.

Figure 3:
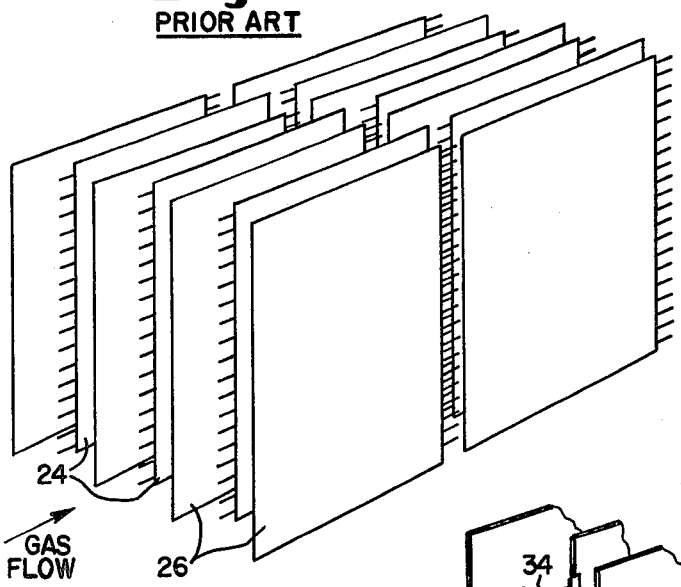
Fig. 3 PRIOR ART
FIG. 3 is a perspective view of another prior art electrostatic precipitator in combination with which the present invention can be practiced, and also illustrating how such a precipitator can be assembled into a multistaged electrostatic precipitator.

An alternate embodiment of an electrostatic precipitator with which this invention may be utilized is shown in FIG. 3 wherein adjacent plates 24 and 26 are the same length. In this alternative form, there are charging zones adjacent to the ends of all of the plates because the plate of the two sets, plates 24 and plates 26, have not been suspended symmetrically fore and aft. The sets of plates are suspended in parallel relationship to each other but offset in the direction of gas flow by distance A. Thus, the leading edges of plates 26 are upstream of the leading edges of plates 24 thereby creating charging zones adjacent to the ends of plates 24 at the upstream end of the plate pack and adjacent to the ends of plates 26 at the downstream end of the plate pack.

Figure 4:
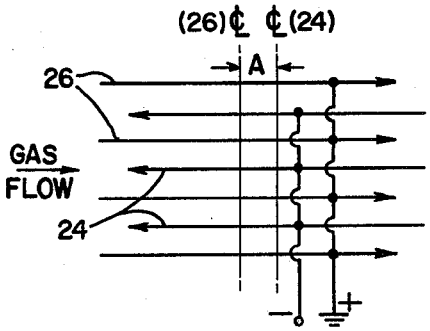
FIG. 4 is a plan view of plate and electrode placement in a FIG. 3 precipitator.

In both of the aforedescribed embodiments D.C voltages are impressed by a well known method on each set of plates so that the two plate sets are at different relative potentials. FIGS. 2 and 4 indicate several of the possible electrical potential relationships between the plates; eg. from plates 24, with needles at the leading edge being at a negative potential relative to a positive ground on plates 26 with needles at the trailing edge; to plates 20, with needles being at a positive potential relative to a negative ground on plates 22, without needles.

Turning now to FIGS. 5 through 9, assuming the plates 20' and 22' correspond to those of FIG. 1; the corona electrode assembly, hereinafter referred to as the corona electrode pair 28, is located adjacent to the vertical edges of plates 20', either upstream or downstream (where they would be at the trailing edge of plate 20') that make up the inner boundary of the charging zone. This arrangement can be constructed at either or both of the upstream and downstream edges of plates 20 (FIGS. 1 and 2) and at the similarly situated edges of plates 24 and plates 26, (see FIGS. 3 and 4).

Figure 5:
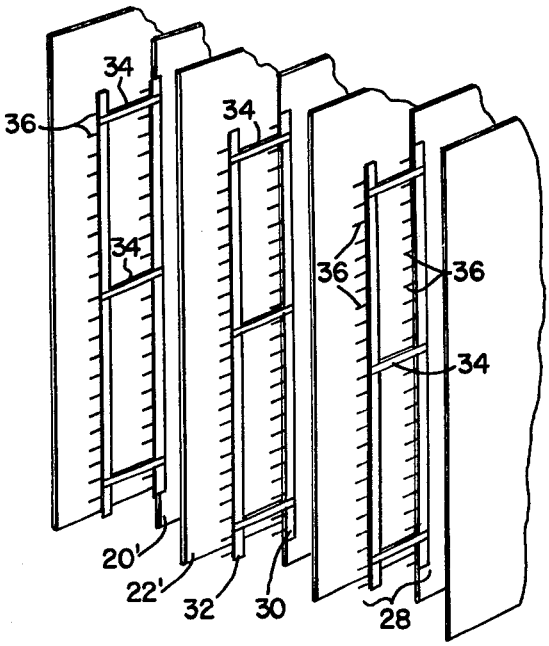
FIG. 5 is a perspective view similar to a portion of FIG. 1 but schematically illustrating the addition of a second corona electrode to a first corona electrode either at the leading or trailing edges of collection plates such as shown in FIGS. 1 through 4 in accordance with this present invention.
Figure 6:
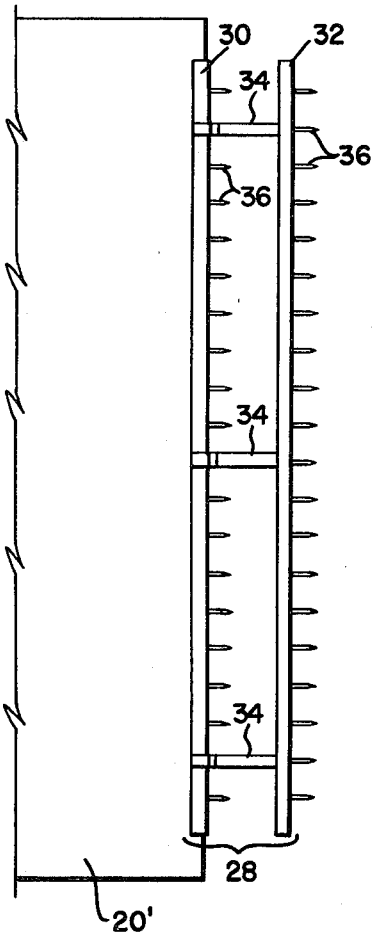
FIG. 6 is a side elevation of a corona electrode pair of needle strips mounted on a partially broken away collection plate.
Figure 7:
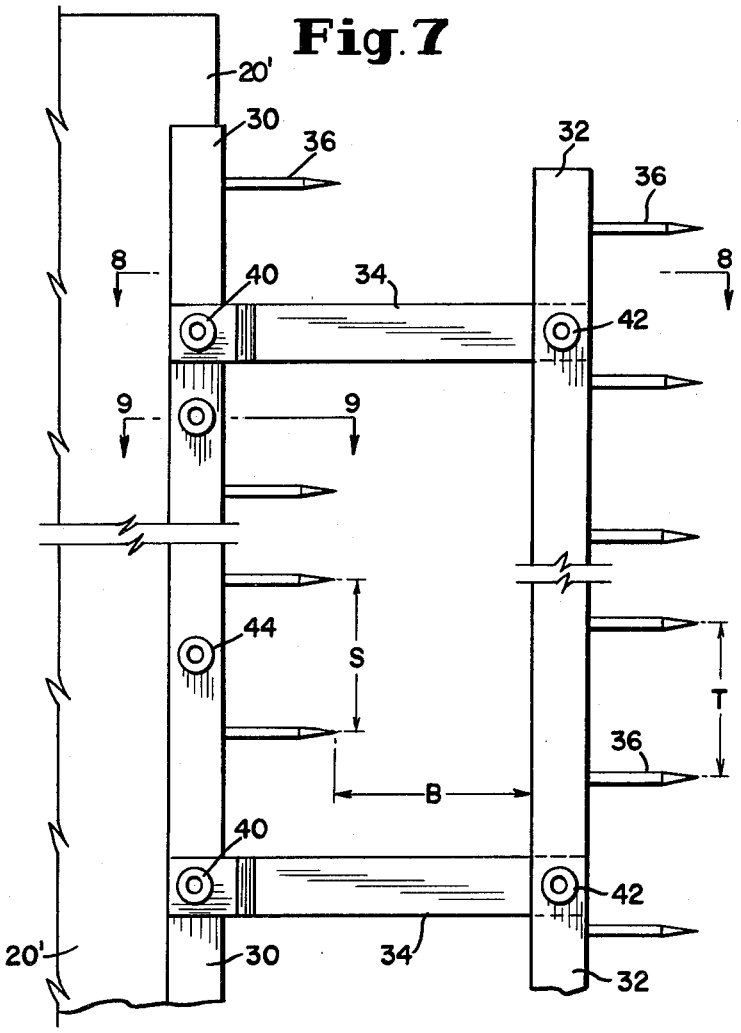
FIG. 7 is an enlarged side elevation view illustrating specific details of construction of a corona electrode pair as seen in FIG. 6.
Figure 8:
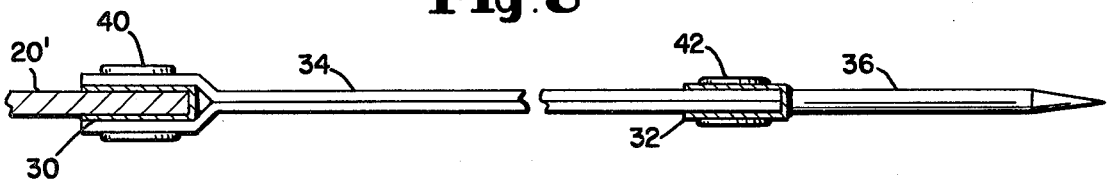
FIG. 8 is a sectional plan view taken along line 8—8 of FIG. 7 showing details of corona electrode pair construction.
Figure 9:
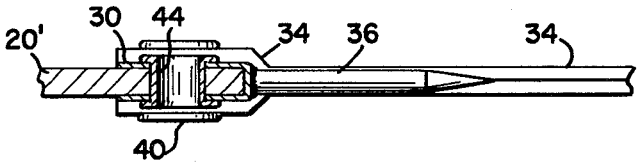
FIG. 9 is a sectional plan view taken along line 9—9 of FIG. 7 showing further details of corona electrode pair construction.

In one embodiment of this invention, the corona electrode pair 28, as shown in FIGS. 5 and 6, is made of two independent sheet metal electrode strips 30 and 32 made preferrably of a steel channel section to each of which needle points 36 are attached as by welding at fixed intervals S and T (FIG. 7) along the length of the respective strips. The distances S are equal and the distances T are equal but the two distances need not be equal; however, the distance relationships and the needle length relationships must each be in accord with the teachings of the aforementioned Hayashi Patent. The two strips are secured to each other by connecting members 34 which must be strong enough to support strip 32 and to withstand the expected vibrational and structural constraints of electrostatic precipitator operation. Connecting members 34 are preferrably made of steel for strength purposes and so as to be electrically conductive and are secured to electrode strip 32 as by rivets 42, and to electrode strip 30 as by rivets 40 which pass through electrode strip 30 and the collection plate to which electrode strip 30 has been secured as by rivets 44. The point of connection between connecting member 34 and electrode strip 30 corresponds to the position of a needle 36 on that strip which has been omitted at such connecting point. This maintains the required electrical clearances between needles. The specific distance B (FIG. 7) is maintained by the length of connecting means 34 and is equal to the plate to plate spacings of adjacent plates in plate set 20' and plate set 22'.

The corona electrode pair assembly as shown in FIG. 6 may of course be assembled separately from the collecting plate and secured by welding in lieu of rivets 40.

This leaves the channel in strip 30 open. The assembled corona electrode pair assembly may then be mounted on to the appropriate edges of the plates via the channel strip 30 and secured by rivets 44 or other suitable means so that the corona electrode pair is located within the charging zone.

In actual practice, the length, in the direction of air flow, of the charging zone i.e. the distance from the upstream edge of plates 22 to the upstream edge of plates 20, is approximately equal to double the length of the corona electrode from needle 36 tip to the furthermost point of strip 30 or 32 plus double the specific distance B. In a standard 80 mm plate spacing configuration this distance is approximately 235 mm. By spacing the electrodes 30 and 32 at the distance B in this manner with respect to plates 20', the hydrodynamic effect as well as the increased charging efficiency of the extended active corona region are both brought to bear on the target particles thus increasing collection efficiencies.

This invention has proven an effective substitute to adding additional collection stages of conventional collection to existing electrostatic precipitators that needed to become more efficient in order to meet stringent performance requirements. This invention will also provide an inexpensive means of retrofitting existing electrostatic precipitators to meet the even more restrictive standards that may be mandated in the future, as well as to meet original design performance with small more efficient electrostatic precipitators. Electrostatic precipitators utilizing the improvements of this present invention will require lower capital investment for the efficiency of operation that is derived, and be much smaller without sacrificing necessary collection efficiencies.

Figure 10:
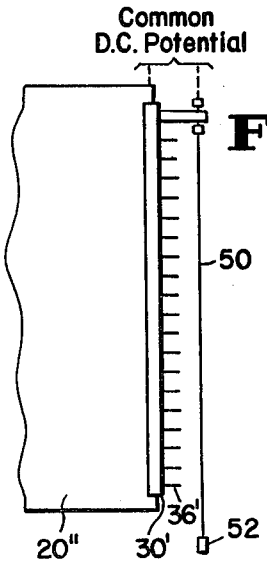
FIG. 10 is a side elevation of an alternative embodiment of a corona electrode pair of this invention.

Another embodiment of the invention involves a known corona electrode configuration as shown in FIG. 10 which is a weighted 52 hanging wire 50, of the various known shapes suitable for production of corona. This alternative corona electrode is placed at an optimal distance from the needle strip corona electrode 30 and located within the charging zone in the plane of the collecting plate and the plane of the needles to take advantage of the features of this invention.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. For use in an electrostatic precipitator of the parallel and vertical plate type with lateral gas flow paths between the plates, an electrode apparatus, including a plurality of flat collecting plates spaced apart at equal distances, comprising, on at least one of said flat collecting plates: a first corona electrode with a first elongated body portion and plural spaced apart needles mounted along said first elongated body portion and disposed parallel with the gas flow path; at least one second corona electrode having a second elongated body portion; means for mounting said first corona electrode and said said second corona electrode so as to maintain said second elongated body portion parallel with said first elongated body portion and at a predetermined distance from the needles on said first elongated body portion, such distance being substantially equal to the spacing between said spaced apart, parallel flat collecting plates, said two elongated body portions being in parallel disposition in the same plane with said at least one flat plate: said mounting means including means for securing said two corona electrodes in a common electrically conductive manner to a vertical edge of said plate; and a D.C. electrical source connected to and for maintaining said at least one collecting plate and the associated said first and second corona electrodes at the same potential.

2. An electrode apparatus as defined in claim 1, wherein each of said corona electrodes comprise elongate strips of a conductive material mounting a plurality of needle-shaped means, spaced apart and disposed normal to a vertical edge of and in a common plane including the associated plate.

3. An electrode apparatus as defined in claim 1, wherein said second corona electrode comprises a weighted wire in a common plane including the associated collecting plate and parallel to the edge of said collecting plate.

4. An electrostatic precipitator apparatus of the multiple, equi-distantly spaced apart, parallel flat collecting plate type, including a gas stream inlet, a gas stream outlet, a discharging port for collected dust, a gas stream passage in which sets of collecting plates are supported, a first set of collecting plates, a second set of collecting plates, each plate in a set having vertical upstream and downstream edges as defined by the direction of gas flow, each set of the two sets of plates being maintained at a different electrical potential by a D.C. electrical source, a corona electrode means secured in an electrically conductive manner on vertical edges of at least some of said collecting plates, said corona electrode means comprising: a first corona electrode with a first elongated body portion and plural spaced apart needles on said first elongated body portion and along and normal to a vertical edge of said collecting plate, projecting from said plate and parallel with the plane of said plate; at least one second corona electrode having a second elongated body portion; electrically conductive means for mounting said first corona electrode and said second corona electrode so as to maintain said second elongated body portion parallel with said first elongated body portion and at a predetermined distance from the needles of said first corona electrode, such distance being substantially equal to the spacing between said spaced apart, parallel flat collecting plates, at a common electrical potential with one another and the associated plate, and in parallel disposition in a common plane including said associated plate.

5. An electrostatic precipitator apparatus as defined in claim 4, wherein said first set of collecting plates are not as long in the direction of gas flow as are the plates in said second set of collecting plates such that the plates of said second set of collecting plates extend beyond the upstream and downstream edges of said first set of collecting plates by approximately equal distances, wherein said corona electrode means are located at least at the upstream vertical edges of said first set of collecting plate.

6. An electrostatic precipitator apparatus as defined in claim 5, wherein corona electrode means are also located at the downstream vertical edges of said first set of collecting plates.

7. An electrostatic precipitator apparatus as defined in claim 5 or 6, wherein the distance the upstream and downstream edges of the plates of said second set of collecting plates extend beyond the respective upstream and downstream edges of the plates of said first set of collecting plates is at least the sum of: the maximum length of said first corona electrode as measured in the direction of gas flow, the specific distance between said first corona electrode and said second corona electrode, the maximum length of said second corona electrode as measured in the direction of gas flow, and the distance between adjacent plates as measured along a line perpendicular to the planes of the plates.

8. An electrostatic precipitator apparatus as defined in claim 4, wherein said first and second sets of collecting plates are essentially the same length but are offset in the direction of gas flow such that the upstream vertical edges of said second set of collecting plates extend upstream of the upstream vertical edges of said first set of collecting plates, wherein a said corona electrode means is located at the upstream vertical edge of each plate of said first set of collecting plates.

9. An electrostatic precipitator apparatus as defined in claim 8, wherein said corona electrode means are also located at the downstream vertical edges of the plates in said second set of collecting plates.

10. An electrostatic precipitator apparatus as defined in claim 5, 8 or 9 wherein each of said corona electrodes comprises elongate strips of conductive material mounting a plurality of needle-shaped means, spaced apart and disposed normal to a vertical edge of and in a common plane including the associated plate.

11. An electrostatic precipitator apparatus as defined in claim 5, 8 or 9 wherein said second corona electrode comprises a weighted wire in a common plane including the associated plate and parallel to the vertical edge of said plate.

* * * * *